US005771969A

United States Patent [19]

Garay

[11] Patent Number: 5,771,969

[45] Date of Patent: Jun. 30, 1998

[54] HELICAL BEARING ANCHOR AND CATCHER

[75] Inventor: Thomas William Garay, Calgary, Canada

[73] Assignee: Excalibre Oil Tools Ltd., Calgary, Canada

[21] Appl. No.: 551,408

[22] Filed: Nov. 1, 1995

[51] Int. Cl.[6] ..... E21B 40/00

[52] U.S. Cl. ..... 166/211; 166/214

[58] Field of Search ..... 166/209–212, 166/214–216

[56] References Cited

U.S. PATENT DOCUMENTS

| | | | |
|---|---|---|---|
| 2,832,422 | 4/1958 | Cross | 166/216 |
| 3,036,640 | 5/1962 | Clark | 166/216 |
| 3,077,933 | 2/1963 | Bigelow | 166/217 |
| 3,664,417 | 5/1972 | Conrad | 166/216 |
| 4,317,485 | 3/1982 | Ross | 166/216 |
| 4,580,631 | 4/1986 | Baugh | 166/208 |
| 4,605,063 | 8/1986 | Ross | 166/216 |
| 4,702,313 | 10/1987 | Greenlee et al. | 166/216 |
| 4,750,559 | 6/1988 | Greenlee et al. | 166/216 |
| 4,811,785 | 3/1989 | Weber | 166/242 |
| 4,901,793 | 2/1990 | Weber | 166/68.5 |
| 5,275,239 | 1/1994 | Obrejanu | 166/210 |
| 5,327,975 | 7/1994 | Land | 166/216 X |
| 5,330,002 | 7/1994 | Saunders | 166/216 X |
| 5,350,013 | 9/1994 | Jani et al. | 166/217 |
| 5,431,230 | 7/1995 | Land et al. | 166/50 X |

FOREIGN PATENT DOCUMENTS

| | | |
|---|---|---|
| 633778 | 1/1962 | Canada . |
| 653892 | 12/1962 | Canada . |
| 890742 | 1/1972 | Canada . |
| 933089 | 9/1973 | Canada . |
| 973473 | 8/1975 | Canada . |
| 1081613 | 7/1980 | Canada . |
| 1147258 | 5/1983 | Canada . |
| 1162845 | 2/1984 | Canada . |
| 1180594 | 1/1985 | Canada . |
| 1255584 | 6/1989 | Canada . |
| 1274470 | 9/1990 | Canada . |
| 1281998 | 3/1991 | Canada . |

*Primary Examiner*—Roger J. Schoeppel
*Attorney, Agent, or Firm*—Thomas E. Malyszko

[57] ABSTRACT

A Helical Bearing Anchor and Catcher for the insertion into a well conduit to anchor well equipment in both linear directions and rotation in one direction. The device has a helical groove in either the mandrel or the drag body to accommodate the helical bearing. The helical bearing has holes within it to accommodate shear pins. The shear pins translate the linear motion from the helical bearing to the drag body. The drag body has a conical surface which contacts slips to drive them outward and grip the inner well conduit wall. Once the slip grips the inner well conduit wall the mandrel and the attached well equipment can not move linearly in either direction or rotate further in the setting direction within the well conduit. The anchor catcher can be unset by rotating the mandrel in the direction opposite to the setting direction. The drag body, pins, and helical bearing all move downward away from the slip. The slip then moves away from the inner well conduit wall allowing the anchor catcher to be moved to a different location within or removed from the well conduit. A secondary unsetting method is provided by applying tension above that of the maximum shear force of the pins causing the pins to shear. The mandrel will move upwards along with the cone element away from the slips allowing the slips to move away from the inner well conduit wall which in turn allows the anchor catcher to be removed from the well conduit.

14 Claims, 3 Drawing Sheets

HELICAL BEARING ANCHOR AND CATCHER

The invention relates to an anchor catcher for anchoring and catching well equipment within a well conduit. These devices anchor well equipment in both linear directions and usually in one rotational direction within the well conduit.

BACKGROUND OF THE INVENTION

Various types of anchor catchers are known utilizing a combination of a right hand and a left hand thread or using one thread only. Threaded types of anchor catchers have the disadvantage of being expensive to manufacture and have a stop pin which is susceptible to breakage during use.

One type is described and illustrated in U.S. Pat. No. 3,077,933 of Bigelow. This anchor catcher utilizes two sets of threads one having a right hand orientation and the other having a left hand orientation. The manufacturing of both the male and female portions of both threads becomes expensive. The design also incorporates a stop pin for limiting the motion of the cones when unsetting the tool. These stop pins are susceptible to breakage during use.

Another type of anchor catcher is illustrated and described in Canadian Patent No. 933,089 of Conrad. This anchor catcher utilizes only one thread. The manufacturing of the thread would also be expensive. This design also incorporates a stop pin which is also susceptible to breakage.

The present invention incorporates a helical bearing which accomplishes several functions. The bearing provides the transformation of rotational movement into linear movement and also provides a stop surface at each end of the bearing. The bearing also accommodates the shear pins for a secondary unsetting ability. The invention, by using one component to perform several functions, is very inexpensive to manufacture and is not susceptible to breakage.

SUMMARY OF THE INVENTION

In one preferred embodiment of the invention, there is provided an anchor catcher for the insertion into a well conduit. The anchor catcher prevents linear movement in both directions and rotational movement in one direction of the well equipment. The device comprises a mandrel that is attached to said well equipment, a cone element that shoulders against the mandrel. The cone element has a conical surface. A drag means having a friction surface which contacts the inner well conduit wall which urges the drag body to remain stationary during operation of the device. The drag body has portions to accommodate the drag means and also has a conical surface. There is a plurality of slips each of which has a plurality of concave inner surfaces, gripping teeth and a recess to accommodate a spring. A slip retaining means retains said slips within said anchor catcher. The spring means urges said slip inwards away from the inner well conduit wall which enables the anchor catcher to be retrieved from or moved linearly within the well conduit. The bearing is helically shaped and has at least one hole. A pin is attached to the drag body and has portions inserted into the hole of the bearing. The mandrel has a groove that accommodates the bearing. Rotation of the mandrel causes the bearing, pins, and drag body to move towards the cone element. The conical surface of the drag body contacts one of the inner concave surfaces of the slip, the other inner concave surface contacts the conical surface of the cone element. This drives the slips outward toward the inner well conduit wall engaging the gripping teeth with the inner well conduit wall.

In accordance with another preferred embodiment of the invention, there is provided an anchor catcher for the insertion into a well conduit. The anchor catcher prevents linear movement in both directions and rotational movement in one direction of the well equipment. The device comprises a mandrel that is attached to the well equipment and a cone element that shoulders against the mandrel. The cone element has a conical surface. A drag means having a friction surface which contacts the inner well conduit wall urges the drag body to remain stationary during operation of the device. The drag body has portions to accommodate the drag means and also has a conical surface. There is a plurality of slips each of which has a plurality of concave inner surfaces, gripping teeth and a recess to accommodate a spring. A slip retaining means retains said slips within the anchor catcher. The spring urges the slip inwards away from the inner well conduit wall which enables the anchor catcher to be retrieved from or moved within the well conduit. The bearing is helically shaped and has at least one hole. A pin is inserted into the bearing and has portions inserted into a dimple in the mandrel. The drag body has a groove that accommodates the bearing. Rotation of the mandrel causes the drag body to move towards the cone element. The conical surface of the drag body contacts one of the inner concave surfaces of the slip, the other inner concave surface contacts the conical surface of the cone element. This drives the slips outward toward the inner well conduit wall engaging the gripping teeth with the inner well conduit wall.

In either embodiment of the invention the anchor catcher may also have a stop surface which contacts the end of the bearing to limit the motion of the drag body when unsetting the anchor catcher.

In either embodiment of the invention the anchor catcher may also have pins that will shear off to provide a secondary unsetting ability when tension above the failure shear force of the pins is applied to the mandrel.

In either embodiment of the invention the anchor catcher may also have a mandrel with a passage to allow for the movement of fluid.

In either embodiment of the invention the anchor catcher may also have threads to attach the well equipment to the mandrel.

BRIEF DESCRIPTION OF THE DRAWINGS

Further features and advantages of the invention will become apparent from the text set forth below, and the accompanying drawings.

DETAILED DESCRIPTION OF THE PREFERRED EMBODIMENT

Figure 1:
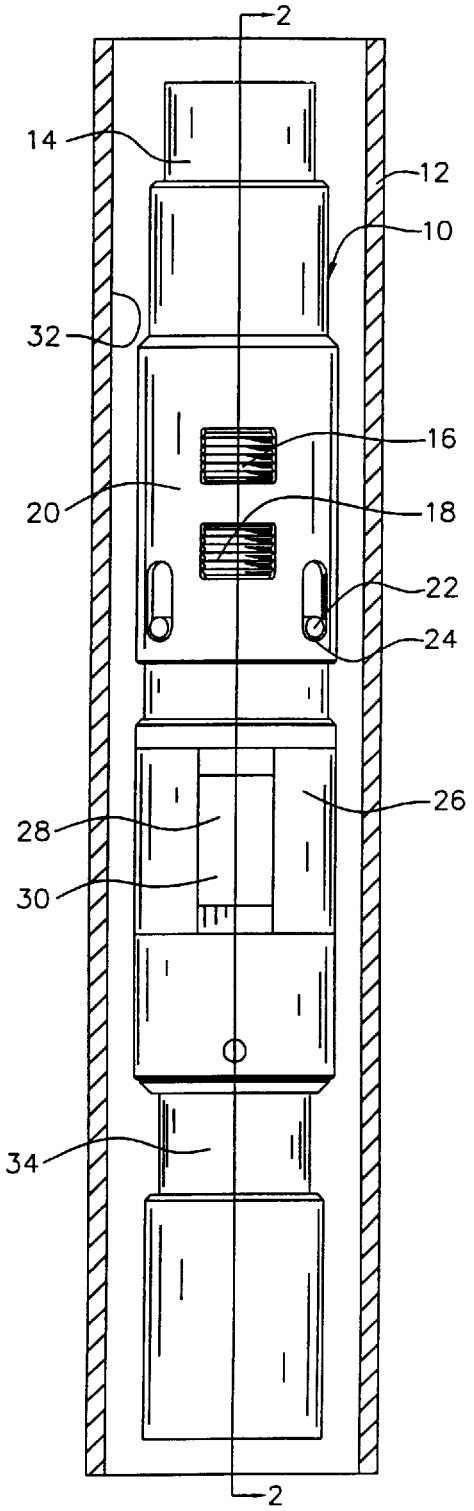
FIG. 1 is a side view of the anchor catcher in accordance with the invention within the well conduit. The well conduit is shown in section.

FIG. 1 shows the anchor catcher 10 within the well conduit 12 and having the well equipment 14 attached above and below. The slips 16 are shown having gripping teeth 18 and positioned within the slip retainer 20. The upper cap screw 22 can be seen to contact the shoulder 24 on the slip retainer 20. The drag body 26 can be seen to accommodate the drag means 28 and the friction surface 30 which contacts the inner well conduit wall 32. The well equipment 14 is shown attached to the mandrel 34.

Figure 2:
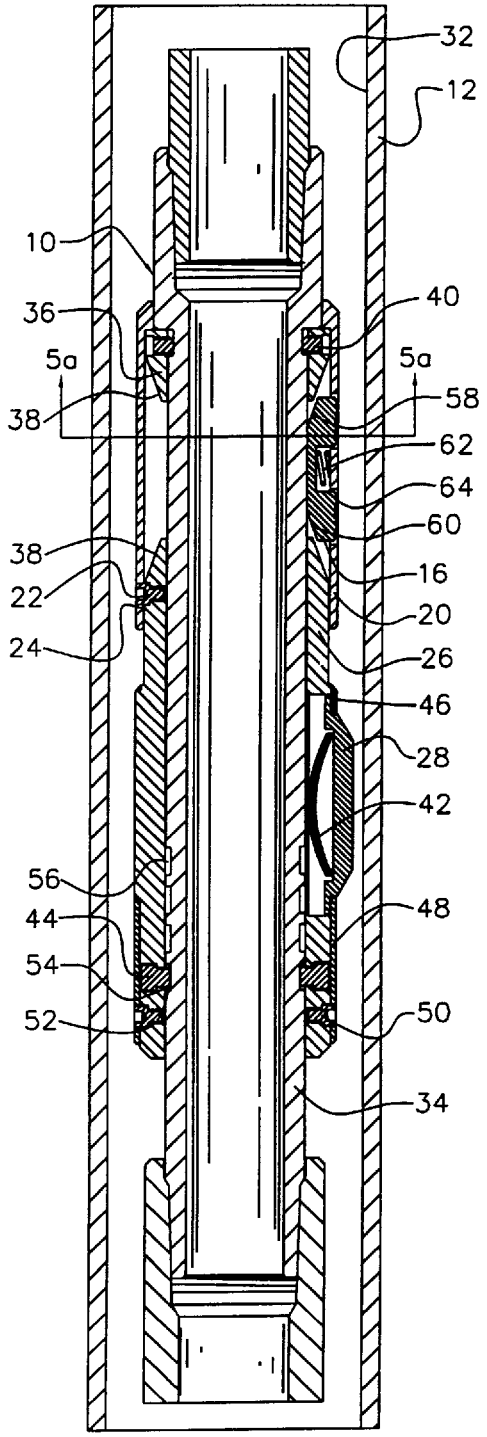
FIG. 2 is a section of the anchor catcher taken along line A—A in FIG. 1 in the unset position.

FIG. 2 shows the anchor catcher 10 within the well conduit 12. The cone element 36 is shouldered against the mandrel 34. The conical surface 38 is also shown. The cone set screws 40 are used to retain the cone element 38 on the mandrel 34. The drag body 26 has accommodation for the drag means 28 and also has drag springs 42 to urge the drag means 28 outwards against the inner well conduit wall 32. The contact of the drag means 28 and the inner well conduit wall 32 causes friction which urges the drag body 26 to remain stationary while the mandrel 34 rotates within. The upper cap screw 22 is shown to contact the shoulder 24 which prevents the slip retainer 20 from moving upwards and allowing the slip 16 to contact the cone element 36. The upper cap screw 22 also prevents the drag body 26 from moving off of the mandrel 34 after the pins have sheared. The drag body also has a conical surface 38 which does not contact the slip 16 in the unset position. The upper retaining ring 46 and the lower retaining ring 48 keep the drag means 28 from escaping the anchor catcher 10. The lower cap screws 50 attach the lower retaining ring 48 to the drag body 26. The lower retaining ring 48 also keeps the pins 44 within the drag body 26. The helical bearing 52 accommodates the pins 44 within a hole 54. The helical groove 56 in the mandrel 34 can be seen to accommodate the helical bearing 52.

Figure 3:
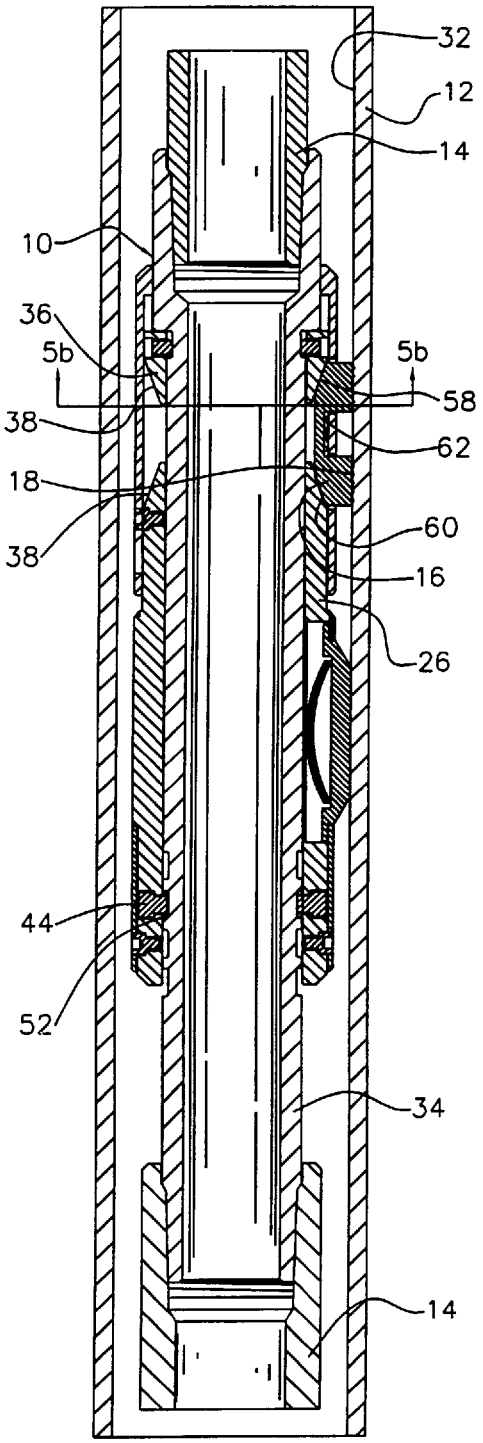
FIG. 3 is a section of the anchor catcher taken along line A—A in FIG. 1 in the set position.

FIG. 3 shows the anchor catcher 10 in the set position. When the mandrel 34 is rotated in the setting direction the helical bearing 52, pins 44 and the drag body 26 move upwards. The conical surface 38 moves towards the cone element 36. The conical surface 38 on the drag body 26 and the conical surface 38 on the cone element 36 contact the lower concave inner surface 60 and the upper concave inner surface 58 of the slips 16 respectively driving the slips 16 outwards. The gripping teeth 18 contact and bite into the inner well conduit wall 32 and cease moving. The mandrel 34 and the attached well equipment 14 cannot move with respect to the well conduit 12 in either up or down linear direction or any further in the rotational setting direction.

The anchor is unset by rotating the mandrel 34 in the direction opposite to the setting direction. The rotation causes the helical bearing 52, pins 44 and the drag body 26 to move downwards. The conical surface 38 on the drag body 26 moves away from the lower concave inner surface 60 of the slips 16. The spring 62 urges the slip 16 away from the inner well conduit wall 32. This allows the anchor catcher 10 to be moved to a different position in the well conduit 12 and be reset or to remove the anchor catcher 10 from the well conduit 12.

An alternate method of unsetting the anchor catcher 10 is to pull tension on the mandrel 34 until the maximum shear force of the pins 44 is exceeded. The mandrel 34, and the cone element 36 will then move upward. The conical surface 38 of the cone element 36 will move away from the upper concave inner surface 58 of the slip 16. The spring 62 urges the slips 16 away from the inner well conduit wall 32. This allows the anchor catcher 10 to be removed from the well conduit 12.

Figure 4:
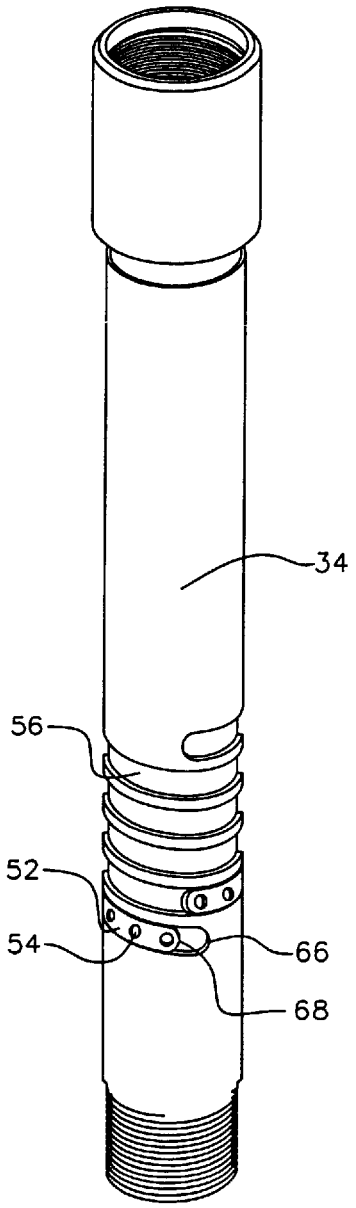
FIG. 4 is a perspective view of the bearing located within the mandrel groove.

FIG. 4 shows the mandrel 34 with the helical bearing 52 within the helical groove 56. The stop surface 62 is shown at the end of the helical groove 56. The end of the bearing 64 will shoulder against the stop surface 62 when the anchor catcher 10 is completely unset. The holes 54 are also shown within the helical bearing 52.

Figure 5A:
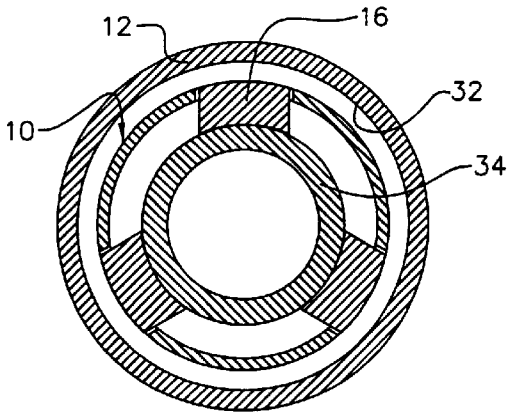
FIG. 5*a* is a section of the anchor catcher taken along line B—B in FIG. 2 in the unset position.

FIG. 5*a* shows the section of the anchor catcher 10 in FIG. 2 in the unset position. The slips 16 are shown to be away from the inner well conduit wall 32 and contacting the mandrel 34.

Figure 5B:
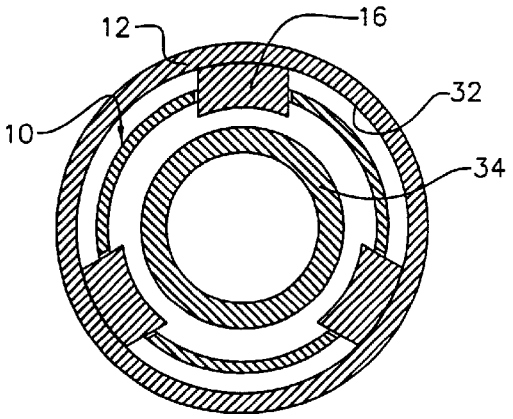
FIG. 5*b* is a section of the anchor catcher taken along line C—C in FIG. 3 in the set position.

FIG. 5*b* shows the section of the anchor catcher 10 in FIG. 3 in the set position. The slips 16 are shown to be contacting the inner well conduit wall 32.

Figure 6:
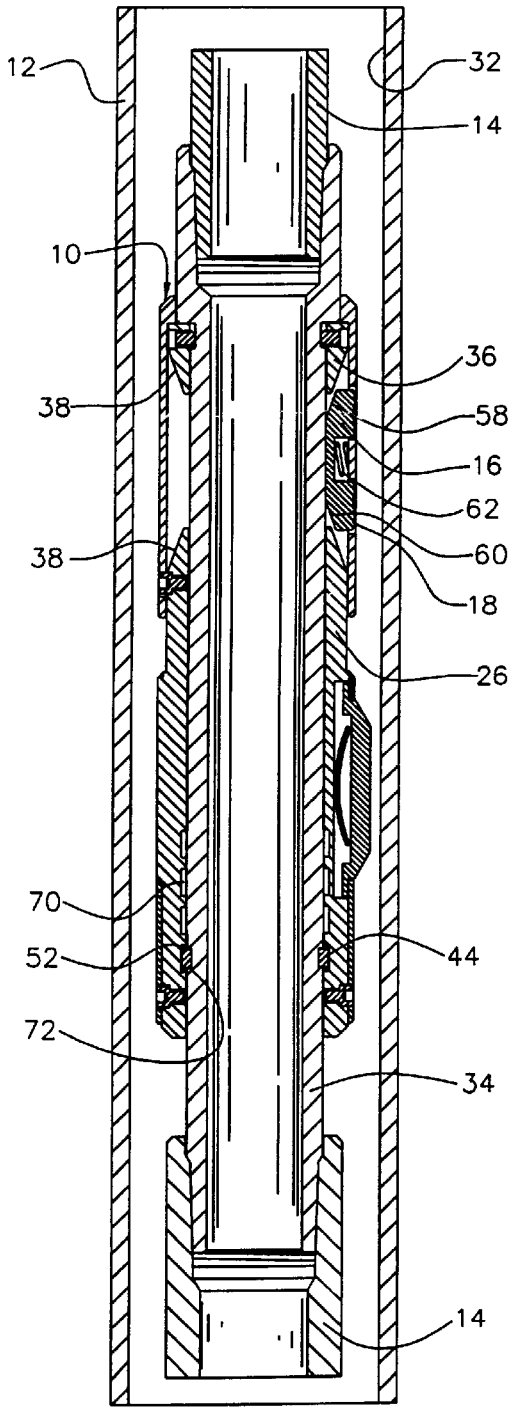
FIG. 6 is a section of another preferred embodiment within the well conduit.

FIG. 6 shows another preferred embodiment in which the drag body 26 accommodates the helical bearing 52 within the drag body helical groove 70. The pins 44 are inserted through the helical bearing 52 and into dimples 72 in the mandrel.

When the mandrel 34 is rotated in the setting direction the helical bearing 52, and the pins 44 also rotate. The drag body 26 moves upwards and the conical surface 38 moves towards the cone element 36. The conical surface 38 on the drag body 26 and the conical surface 38 on the cone element 36 contact the lower concave inner surface 60 and the upper concave inner surface 58 of the slips 16 respectively driving the slips 16 outwards. The gripping teeth 18 contact and bite into the inner well conduit wall 32 and cease moving. The mandrel 34 and the attached well equipment 14 cannot move with respect to the well conduit 12 in either up or down linear direction or any further in the rotational setting direction.

The anchor is unset by rotating the mandrel 34 in the direction opposite to the setting direction. The rotation also causes the helical bearing 52 and pins 44 to rotate. The drag body 26 moves downwards and the conical surface 38 on the drag body 26 moves away from the lower concave inner surface 60 of the slips 16. The spring 62 urges the slip 16 away from the inner well conduit wall 32. This allows the anchor catcher 10 to be moved to a different position in the well conduit 12 and be reset or to remove the anchor catcher 10 from the well conduit 12.

An alternate method of unsetting the anchor catcher 10 is to pull tension on the mandrel 34 until the maximum shear force of the pins 44 is exceeded and the pins shear. The mandrel 34, and the cone element 36 will then move upward. The conical surface 38 of the cone element 36 will move away from the upper concave inner surface 58 of the slip 16. The spring 62 urges the slips 16 away from the inner well conduit wall 32. This allows the anchor catcher 10 to be removed from the well conduit 12.

Although the embodiments of the invention are described and illustrated, the present invention is not limited to the features of these embodiments, but includes all variations and modifications within the scope of the claims.

I claim:

1. An anchor catcher for insertion into a well conduit to prevent linear movement in both directions and rotational movement in one direction of well equipment, comprising:

a mandrel attached to said well equipment;

a cone element shouldering against said mandrel and having a first conical surface;

a drag means having a friction surface which contacts an inner well conduit wall;

a drag body having portions to accommodate the drag means and having a second conical surface;

a plurality of slips each having opposed concave inner surfaces, gripping teeth and a recess which accommodates a spring for urging said slip inward away from the inner well conduit wall;

a slip retaining means which retains said slips within said anchor catcher;

a bearing element defined by an elongate helically shaped body having a plurality of longitudinally spaced holes therein;

pins attached to the drag body and having portions inserted into respective holes in said bearing element; and said mandrel having portions defining a helically shaped track for slideably receiving said bearing element, wherein rotation of said mandrel causes said bearing element, said pins, and in turn said drag body to move towards said cone element so that the second conical surface of said drag body contacts one of the concave inner surfaces of each slip and the other inner concave surface contacts the first conical surface of said cone element to drive said slips outward toward the inner conduit wall to engage the gripping teeth with the inner well conduit wall.

2. The anchor catcher of claim 1 wherein said mandrel forms stop surfaces at opposed ends of said track which contact longitudinally opposed end portions of said bearing element to limit movement of said bearing element within said track when setting and unsetting the anchor catcher.

3. The anchor catcher of claim 2 wherein said pins can shear off to provide a secondary unsetting means when tension above the failure shear force of said pins is applied to said mandrel.

4. The anchor catcher of claim 2 wherein said mandrel has portions defining a passage to allow for the movement of fluid.

5. The anchor catcher of claim 2 wherein said well equipment is attached to said mandrel with threads.

6. The anchor catcher of claim 3 wherein said well equipment is attached to said mandrel with threads.

7. The anchor catcher of claim 4 wherein said well equipment is attached to said mandrel with threads.

8. An anchor catcher for insertion into a well conduit to prevent linear movement in both directions and rotational movement in one direction of well equipment, comprising:

a mandrel attached to said well equipment;

a cone element shouldering against said mandrel and having a first conical surface;

a drag means having a friction surface which contacts an inner well conduit wall;

a drag body having portions to accommodate the drag means and having a second conical surface;

a plurality of slips each having opposed concave inner surfaces, gripping teeth and a recess which accommodates a spring for urging said slip inward away from the inner well conduit wall;

a slip retaining means which retains said slips within said anchor catcher;

a bearing element defined by an elongate helically shaped body having a plurality of longitudinally spaced holes therein;

pins inserted into the bearing element and having portions inserted into respective dimples in said mandrel; and said drag body having portions defining a helically shaped track for slideably receiving said bearing element, wherein rotation of said mandrel causes said pins, said bearing element, and in turn said drag body to move towards said cone element so that the second conical surface of said drag body contacts one of the concave inner surfaces of each slip and the other inner concave surface contacts the first conical surface of said cone element to drive said slips outward toward the inner well conduit wall to engage the gripping teeth with the inner well conduit wall.

9. The anchor catcher of claim 8 wherein said drag body forms stop surfaces at opposed ends of said track which contact longitudinally opposed end portions of said bearing element to limit movement of said bearing element within said track when setting and unsetting the anchor catcher.

10. The anchor catcher of claim 9 wherein said pins can shear off to provide a secondary unsetting means when tension above the failure shear force of said pins is applied to said mandrel.

11. The anchor catcher of claim 9 wherein said mandrel has portions defining a passage to allow for the movement of fluid.

12. The anchor catcher of claim 9 wherein said well equipment is attached to said mandrel with threads.

13. The anchor catcher of claim 10 wherein said well equipment is attached to said mandrel with threads.

14. The anchor catcher of claim 11 wherein said well equipment is attached to said mandrel with threads.

* * * * *